US007606505B2

(12) United States Patent
Kikuchi et al.

(10) Patent No.: US 7,606,505 B2
(45) Date of Patent: Oct. 20, 2009

(54) IMAGE FORMING METHOD AND APPARATUS CAPABLE OF EFFECTIVELY PERFORMING CHARGING OPERATION

(75) Inventors: Hideo Kikuchi, Kanagawa-ken (JP); Yasuhisa Ehara, Kanagawa-ken (JP); Hiroshi Yoshizawa, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 363 days.

(21) Appl. No.: 11/314,233

(22) Filed: Dec. 22, 2005

(65) Prior Publication Data

US 2006/0165422 A1 Jul. 27, 2006

(30) Foreign Application Priority Data

Dec. 27, 2004 (JP) ..... 2004-375653

(51) Int. Cl.
*G03G 15/08* (2006.01)
*G03G 15/10* (2006.01)

(52) U.S. Cl. ..... 399/27; 399/58; 399/254

(58) Field of Classification Search ..... 399/27–30, 399/58–64, 254
See application file for complete search history.

(56) References Cited

U.S. PATENT DOCUMENTS 6,148,161 A * 11/2000 Usui et al. ..... 399/58
6,389,260 B1 * 5/2002 Kataoka et al. ..... 399/298
2005/0078969 A1 4/2005 Kikuchi
2005/0084272 A1 4/2005 Kikuchi
2005/0095017 A1 5/2005 Kikuchi
2005/0213997 A1 9/2005 Yoshizawa

FOREIGN PATENT DOCUMENTS

JP 2001-083862 3/2001

* cited by examiner

*Primary Examiner*—David M Gray
*Assistant Examiner*—Joseph S Wong
(74) *Attorney, Agent, or Firm*—Harness, Dickey & Pierce

(57) ABSTRACT

An image forming apparatus includes image forming units, a toner supply device, a common-unit detection device, an initial operation execution device, and a determination device. Each image forming unit is detachably provided in the image forming apparatus, and includes at least a development device containing toner. At least two of the image forming units are common image forming units having a common structure. When the common-unit detection device detects a common image forming unit at installation thereof, the initial operation execution device supplies a predetermined amount of toner to a development device of the common image forming unit and mixes to charge the toner by friction for a predetermined time period. Then, the. determination device detects whether the toner in the development device is charged to a predetermined level, and determines, based on the detection, whether to mix the toner one more time for another predetermined time.

20 Claims, 9 Drawing Sheets

IMAGE FORMING METHOD AND APPARATUS CAPABLE OF EFFECTIVELY PERFORMING CHARGING OPERATION

CROSS REFERENCE TO RELATED APPLICATION

This application claims priority to Japanese patent application no. 2004-375653 filed on Dec. 27, 2004, the entire contents of which are hereby incorporated by reference herein.

BACKGROUND OF THE INVENTION

1. Field of the Invention

The present invention relates to an image forming method and apparatus having a plurality of image forming units attachable to and detachable from the image forming apparatus, each including at least a developing device and respectively supplied with toners of a plurality of colors from a plurality of toner supplying devices.

2. Discussion of the Background Art

There is a background image forming apparatus including process cartridges for respective colors of yellow (Y), magenta (M), cyan (C), and black (K), each of which integrally includes at least a photoconductor and a developing device, and which is attachable to and detachable from the image forming apparatus. That is, the background image forming apparatus uses the process cartridges respectively including the developing devices containing toners of the four colors Y, M, C, and K. Therefore, manufacturers of image forming apparatuses are imposed with an extra burden, such as manufacturing management and adjustment according to colors.

In view of the above, there is another background image forming apparatus using common cartridges for toners of different colors supplied thereto. Prior to being installed in the image forming apparatus, the common cartridges are equal in structure for the toners of different colors supplied thereto, with no toner supplied in developing devices of the common cartridges. Only after being installed in the image forming apparatus and toners of the respective colors are supplied in the developing devices, the common process cartridges are differentiated from one another. In this way, the process cartridges are common in structure prior to their installing in the image forming apparatus, and thus the manufacturing management and adjustment according to colors are unnecessary. Further, such items as a seal for identifying the toner color of a process cartridge are also unnecessary. As a result, manufacturing cost can be reduced.

In another background image forming apparatus, process cartridges are differentiated from one another, with their developing devices respectively supplied with the toners of different colors prior to their installing in the background image forming apparatus. In this case, toner supplied in each developing device is precharged to a predetermined level in a production plant before shipping. For example, therefore, even after the process cartridge is left unused for a couple of months before being replaced with a new one, the toner in the developing device is kept charged to some extent. Thus, there is a relatively small difference between the predetermined toner charge level and a toner charge level at the time of replacement of the process cartridge. Therefore, if the toner in the developing device is mixed for a predetermined time period in an initial operation performed in the replacement of the process cartridge, the toner in the developing devices can be increased to a level substantially equal to the predetermined charge level, even if friction chargeability of the toner changes due to environmental or other factors.

Meanwhile, if the process cartridges are common in structure prior to their installing in the image forming apparatus, toners are supplied to the process cartridges only after the process cartridges are installed in the image forming apparatus. Therefore, the toners in the developing devices of the respective process cartridges are hardly charged, when the process cartridges are installed in the image forming apparatus and the developing devices of the respective process cartridges are supplied with the toners for the first time. In the background image forming apparatus in which the common process cartridges are installed, a toner mixing time is set to be longer than in a case in which the common process cartridges are not used, so that toner in each developing device is charged to the predetermined toner charge level. In some cases, however, even if the toner in each developing device is mixed for the longer toner mixing time, the toner in the developing device is not charged to the predetermined toner charge level. This is because of the following reason. When the developing devices of the process cartridges are supplied with the toners for the first time, there is a relatively large difference between the toner charge level of the developing device and the predetermined toner charge level. Therefore, if friction chargeability of the toner changes due to environmental or other factors, the change in the friction chargeability of the toner increases an error in the toner charge level obtained after the toner is mixed for the predetermined time period. As a result, in some cases, even if the toner is mixed for a longer time than in the case of the background image forming apparatus in which the common process cartridges are not used, the toner in each developing device is not charged to the predetermined charge level. Consequently, if the toner mixing time is set to be substantially long in consideration of influences by the environmental or other factors, the toner in the developing device may be charged to an unnecessarily high toner charge level. As a result, density of the toner may decrease, for example.

SUMMARY OF THE INVENTION

This patent specification describes an image forming apparatus. In one example, an image forming apparatus includes a plurality of image forming units, a toner supply device, a common-unit detection device, an initial operation execution device, and a determination device. The plurality of image forming units are detachably provided in the image forming apparatus, and includes at least two common image forming units having a common structure. Further, each of the plurality of image forming units includes a development device. The toner supply device supplies toners of different colors to corresponding development devices of the plurality of image forming units. The common-unit detection device detects each one of the at least two common image forming units at installation thereof. The initial operation execution device executes an initial operation of supplying a predetermined amount of toner to a development device of each one of the at least two common image forming units detected by the common-unit detection device and mixing to charge the toner by friction for a predetermined time period. The determination device detects a status as to whether the toner in the development device is charged to a predetermined level upon completion of the initial operation, and determines whether to mix the toner one more time for another predetermined time period based on the status detected.

This patent specification further describes another image forming apparatus. In one example, another image forming apparatus includes a plurality of image forming means, toner supplying means, common-unit detecting means, initial operation executing means, and determining means. The plurality of image forming means forms toner images of different colors. The plurality of image forming means include at least two common image forming means having a common structure. The toner supplying means supplies toners of the different colors to corresponding development means of the plurality of image forming means. The common-unit detecting means detects each one of the at least two common image forming means at installation thereof. The initial operation executing means executes an initial operation of supplying a predetermined amount of toner to developing means of each one of the at least two common image forming means detected by the common-unit detecting means and mixing to charge the toner by friction for a predetermined time period. The determining means detects a status as to whether the toner in the development means is charged to a predetermined level upon completion of the initial operation, and determines whether to mix the toner one more time for another predetermined time based on the status detected.

This patent specification further describes an image forming method. In one example, an image forming method includes: providing a plurality of image forming units including at least two common image forming units having a common structure, each including a development device; confirming installment of each one of the at least two common image forming units in the image forming apparatus; executing an initial operation of supplying a predetermined amount of toner from a toner supply device to a corresponding development device of each one of the at least two common image forming units confirmed as installed in the confirming step and mixing to charge the toner by friction for a predetermined time period; detecting a status as to whether the toner in the development device is charged to a predetermined level upon completion of the initial operation; and determining whether to mix the toner one more time for another predetermined time period based on the status detected.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
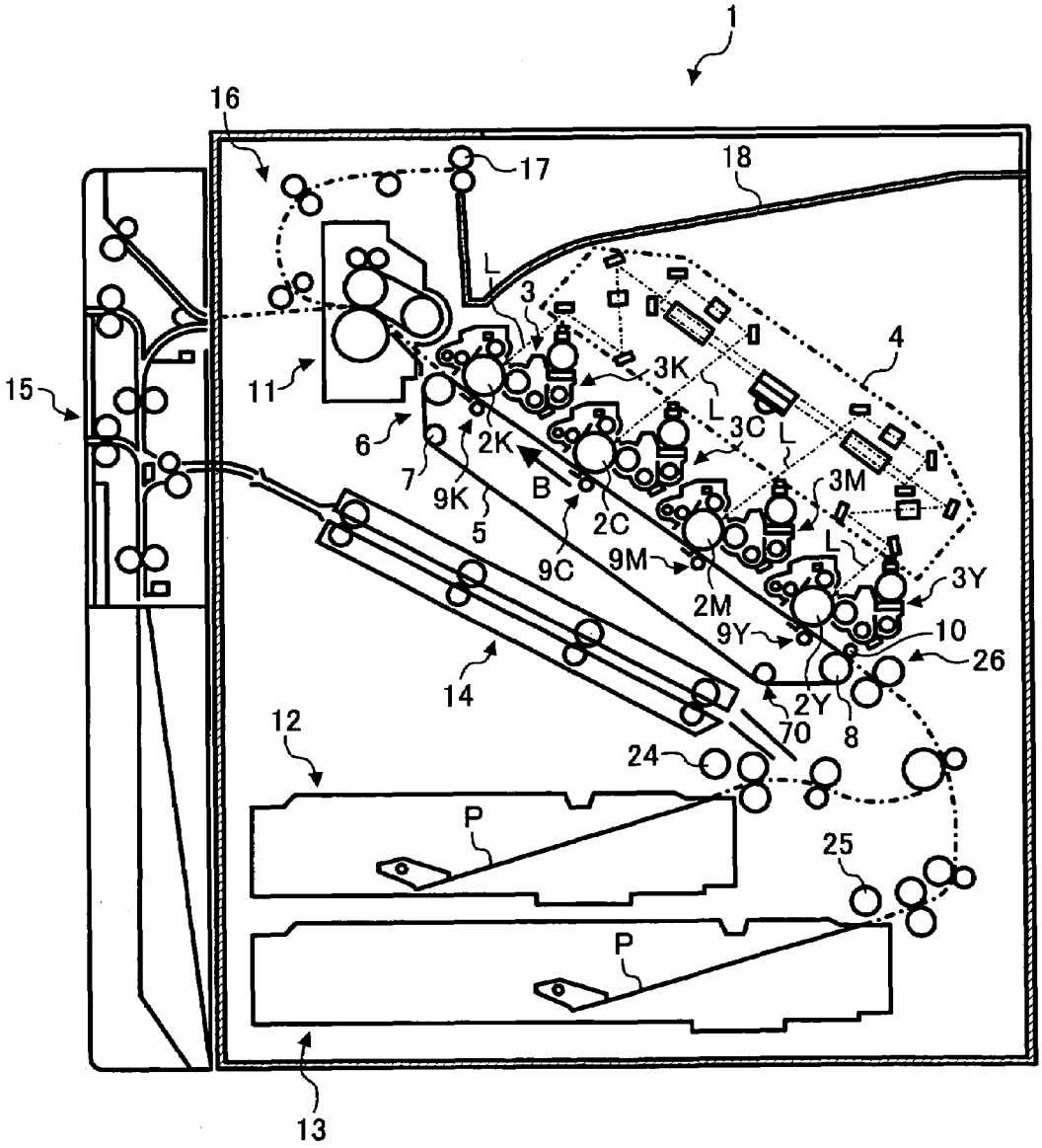
FIG. 1 is a sectional view of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner. Referring now to the drawings, wherein like reference numerals designate identical or corresponding parts throughout the several views, particularly to FIG. 1, a configuration and functions of an image forming apparatus 1 according to an embodiment of the present invention are described.

FIG. 1 illustrates a sectional view of the image forming apparatus 1. The image forming apparatus 1 in the present embodiment is a full-color printer according to an electrophotographic system. As illustrated in FIG. 1, the image forming apparatus 1 is formed into a box shape, and includes image carrying members (i.e., photoconductors) 2Y, 2M, 2C, and 2K, image forming units 3Y, 3M, 3C, and 3K, a writing unit 4, a transfer unit 6, a fixing unit 11, sheet-feeding units 12 and 13, a duplex unit 14, a reversing unit 15, a reversing path 16, a sheet-discharging roller pair 17, a sheet-discharging tray 18, sheet-feeding rollers 24 and 25, a registration roller pair 26, and toner cartridges 30Y, 30M, 30C, and 30K (illustrated in FIG. 3). The transfer unit 6 includes a transfer belt 5, a drive roller 7, a driven roller 8, a plurality of tension rollers 70, transfer brushes 9Y, 9M, 9C, and 9K, and a sheet-adhesion roller 10.

In the image forming apparatus 1, the image forming units 3Y, 3M, 3C, and 3K are provided to respectively form toner images of yellow (Y), magenta (M), cyan (cyan), and black (K) colors (the yellow, magenta, cyan, and black colors are hereinafter referred to as Y, M, C, and K, respectively). The image forming units 3Y, 3M, 3C, and 3K include the image carrying members 2Y, 2M, 2C, and 2K, respectively.

The writing unit 4 (i.e., an exposure device) is placed above the image forming units 3Y, 3M, 3C, and 3K, and includes laser diodes (i.e., light sources) and optical components, such as mirrors. The laser diodes emits laser beams L, and the optical components guide the laser beams L to the image carrying members 2Y, 2M, 2C, and 2K. This operation is performed while the writing unit 4 sequentially moves over the image carrying members 2Y, 2M, 2C, and 2K.

Meanwhile, the transfer unit 6 is placed underneath the image forming units 3Y, 3M, 3C, and 3K. The transfer belt 5 forms a loop and is extended under tension among the drive roller 7, the driven roller 8, and the plurality of tension rollers 70. An outer surface of an upper side of the transfer belt 5 contacts surfaces of the image carrying members 2Y, 2M, 2C, and 2K. On the other hand, the transfer brushes (i.e., transfer devices) 9Y, 9M, 9C, and 9K are provided on an inner surface of the upper side of the transfer belt 5 to face, via the transfer belt 5, the image carrying members 2Y, 2M, 2C, and 2K, respectively. Each of the transfer brushes 9Y, 9M, 9C, and 9K is applied with a transfer bias voltage of a polarity opposite to a polarity of toner contained in a toner image. The sheet-adhering roller 10 is provided on the driven roller 8 via the transfer belt 5. In an upper-left part of the image forming apparatus 1 illustrated in FIG. 1, the fixing unit 11 is provided above the transfer unit 6 for fixing the toner image transferred by the transfer belt 5 onto a recording medium P. In the present embodiment, the transfer unit 6 is obliquely disposed to extend in a direction of a diagonal line of the image forming apparatus 1. Therefore, a horizontally extending space in the image forming apparatus 1 occupied by the transfer unit 6 can be reduced.

Further below the image forming units 3Y, 3M, 3C, and 3K, the sheet-feeding units 12 and 13 are placed for respectively storing recording mediums P of different sizes. Further, the image forming apparatus 1 includes the duplex unit 14 and the reversing unit 15 which form paths for conveying the recording medium P. The duplex unit 14 and the reversing unit 15 are used when images are formed on both surfaces of the recording medium P. The reversing path 16 with branches are formed between the fixing unit 11 and the reversing unit 15. Using the sheet-discharging roller pair 17 placed along the reversing path 16, the reversing path 16 guides the recording medium P to the sheet-discharging tray 18 formed on an upper portion of the image forming apparatus 1.

The image forming units 3Y, 3M, 3C, and 3K form the toner images of the Y, M, C, and K colors on the image carrying members 2Y, 2M, 2C, and 2K, respectively. The image forming units 3Y, 3M, and 3C are similar to each other in structure. The image forming unit 3K forming black toner images is basically similar in structure to the image forming units 3Y, 3M, and 3C, except that the image forming unit 3K has increased durability. Fort the sake of brevity, therefore, a structure of the image forming unit 3M is described in detail below as an example, and description of structures of the other image forming units 3Y, 3C, and 3K is omitted.

Figure 2:
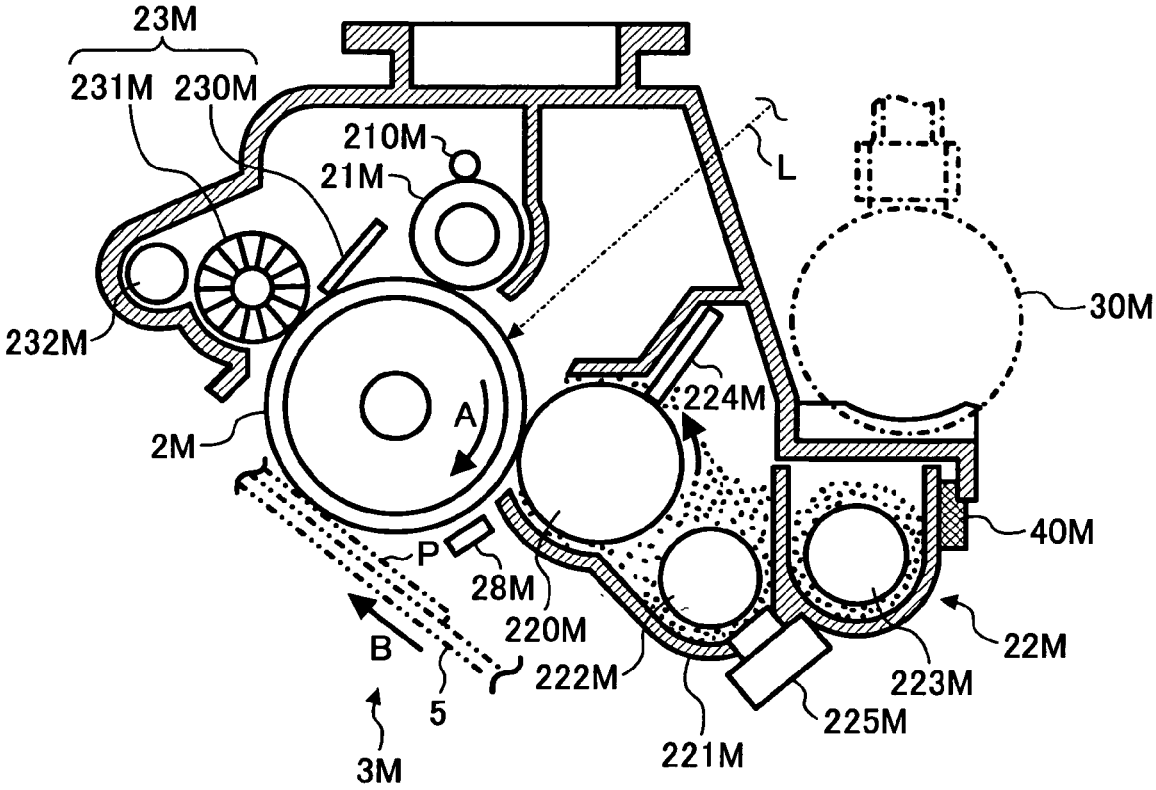
FIG. 2 is a sectional view of an image forming unit used in the image forming apparatus illustrated in FIG. 1.

FIG. 2 illustrates an internal structure of the image forming unit 3M. As illustrated in FIG. 2, the image forming unit 3M includes the image carrying member 2M (i.e., a drum-shaped photoconductor in this example) rotating in a direction indicated by an arrow A. The image carrying member 2M is surrounded by a charging roller (i.e., a charging device) 21M, a development device 22M, and a cleaning device 23M. The image forming unit 3M further includes an IC (integrated circuit) tag 40M, which is described later. The charging roller 21M rotates in a direction opposite to a rotation direction of the image carrying member 2M, and uniformly charge a surface of the image carrying member 2M. A charging-roller cleaning roller 210M is placed on the charging roller 21M for cleaning the charging roller 21M such that the charging-roller cleaning roller 210M is in constant contact with the charging roller 21M. The cleaning device 23M includes a cleaning blade 230M and a cleaning brush 231M. The cleaning blade. 230M cleans the surface of the image carrying member 2M while in contact with the image carrying member 2M from a direction opposite to the rotation direction of the image carrying member 2M. Meanwhile, the cleaning brush 231M cleans the surface of the image carrying member 2M while rotating in contact with the image carrying member 2M in the direction opposite to the rotation direction of the image carrying member 2M.

The image forming unit 3M further includes a reflective photosensor (hereinafter referred to as a P-sensor) 28M, which serves as a toner density adjusting device for adjusting the density of a toner image formed on the image carrying member 2M. The P-sensor 28M is located at a downstream position of the development device 22M in the rotation direction of the image carrying member 2M. The P-sensor 28M detects an optical density of a reference image pattern formed on the image carrying member 2M. Based on the detection, a control unit (not illustrated) of the image forming apparatus 1 changes image forming conditions such as a necessary amount of toner supplied to a developer mixing part of the development device 22M.

The development device 22M uses a two-component developer including a magnetic carrier and a toner. The development device 22M includes a development roller 220M, a development housing 221M, conveying screws 222M and 223M, a development doctor 224M, and a toner density sensor 225M. The development roller 220M is placed such that a part of the development roller 220M is exposed from an opening of the development housing 221M which faces the image carrying member 2M. The toner density sensor 225M includes a magnetic permeability sensor (i.e., a T-sensor) which detects a magnetic permeability of the developer.

Each of the toner cartridges 30Y, 30M, 30C, and 30K is sealed by a lid, a sticker, or the like on a toner supply port before being shipped. The lid, a sticker, or the like is removed and the toner supply opening is opened to install the toner cartridge in the image forming apparatus 1 in replacement of an emptied toner cartridge. The emptied toner cartridge thus replaced is recycled. That is, the emptied toner cartridge is sent to a plant to be refilled with toner.

Figure 3:
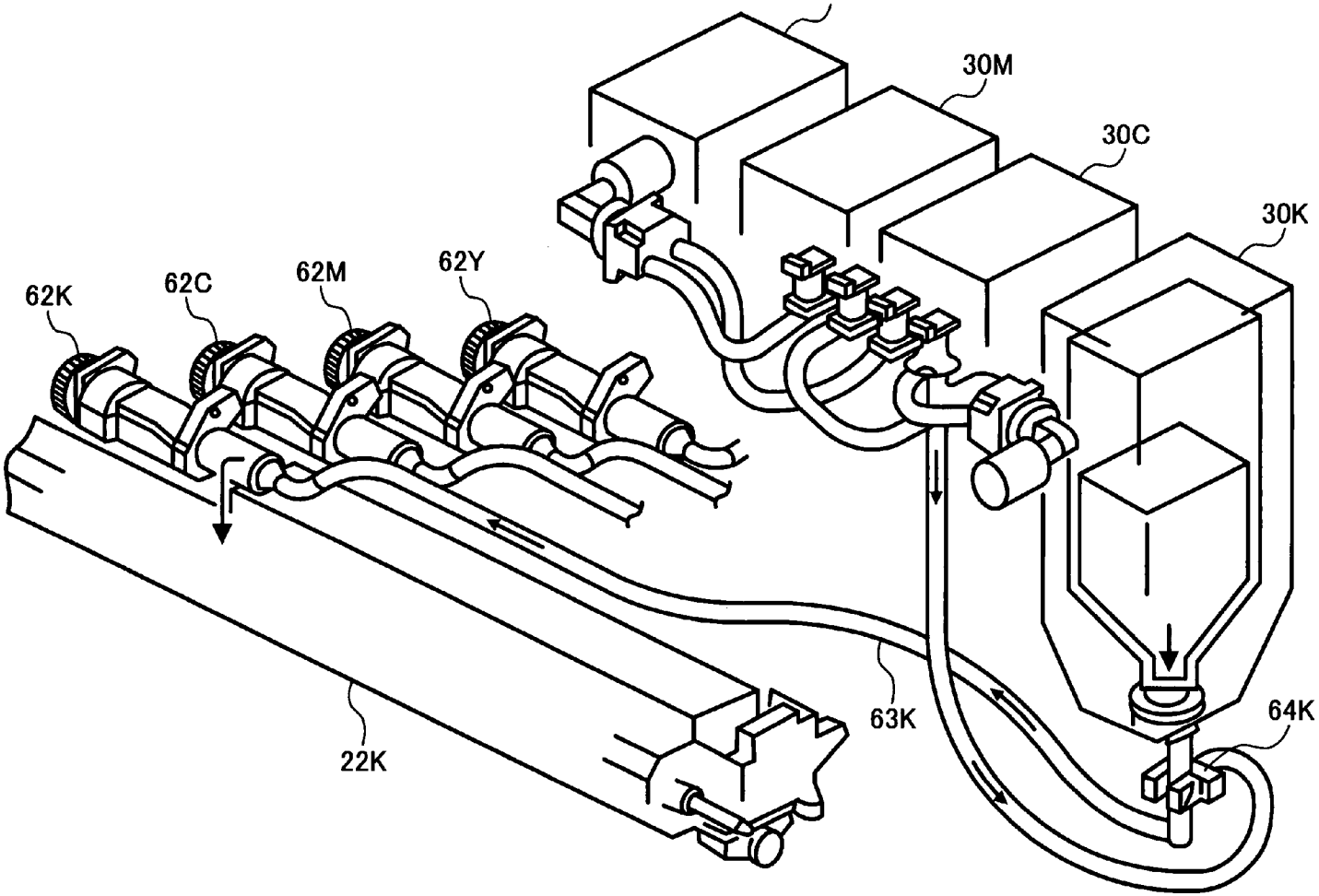
FIG. 3 is a perspective view of a development device and a toner cartridge used in the image forming apparatus illustrated in FIG. 1.

With reference to FIG. 3, mechanism of supplying toner from a toner cartridge to a development device is described. FIG. 3 is an enlarged perspective view illustrating, as an example, the toner cartridge 30K and the development device 22K. As illustrated in FIG. 3, toner contained in the toner cartridge 30K is supplied through a conveying nozzle 63K to the development device 22K by a mohno pump 62K. A transmission optical sensor 64K, which serves as a toner-end sensor detecting depletion of toner (i.e., toner-end) in the toner cartridge 30K, is provided at an end of the conveying nozzle 63K on a side of the toner cartridge 30K. The transmission optical sensor 64K detects a transmission rate of the toner in the toner cartridge 30K to detect the toner-end. Alternatively, the transmission optical sensor 64K may be replaced by the toner density sensor 225M illustrated in FIG. 2 to function as the toner-end sensor.

As illustrated in FIG. 2, after the toner is supplied from the toner cartridge 30M to the development housing 221M of the development device 22M, the toner is mixed with developer by the conveying screws 222M and 223M. Then, the toner and the magnetic carrier are friction-charged to opposite polarities and conveyed to the development roller 220M. A thickness of a developer layer carried on a surface of the development roller 220M is controlled by the development doctor 224M. Then the developer is conveyed to a development position facing the image carrying member 2M. At the development position, a development electric field is formed by an electrostatic latent image formed on the surface of the image carrying member 2M and a development bias voltage applied to the surface of the development roller 220M. The development electric field thus formed causes the toner included in the developer carried on the developer roller 220M to move toward the electrostatic latent image. As a result, the electrostatic latent image on the surface of the image carrying member 2M is developed.

The toner density sensor 225M is provided on a bottom wall of the development housing 221M and outputs a voltage according to the magnetic permeability rate of the developer conveyed by the conveying screws 222M and 223M. The magnetic permeability rate of the developer has a good correlationship with the toner density of the toner included in the developer. That is, the toner density sensor 225M outputs a voltage according to the toner density of the toner included in the developer. A value of the voltage thus output is compared with a target value $V_{tref}$. Then, the mohno pump 62M connected to the toner cartridge 30M is driven for a time period according to a result of the comparison. Accordingly, the toner in the toner cartridge 30M is supplied to the development device 22M. With an operation of the mohno pump 62M (i.e., a toner supplying operation) thus controlled, an appropriate amount of toner is supplied to the developer, when the toner density of the toner included in the developer has decreased after performance of development operations. Accordingly, the toner density of the toner included in the developer contained in the development device 22M is kept within a predetermined value range.

In the image forming apparatus 1 configured as described above, when a operation unit (not illustrated) sends an instruction for performing an image forming operation, a drive source (not illustrated) drives to rotate the image carrying members 2Y, 2M, 2C, and 2K in the clockwise direction in FIG. 1 (i.e., the direction indicated by the arrow A in FIG. 2). Applied with a charging bias voltage by a power source (not illustrated), the charging rollers 211Y, 211M, 211C, and 211K uniformly charge the image carrying members 2Y, 2M, 2C, and 2K, respectively. The image carrying members 2Y, 2M, 2C, and 2K thus charged by the charging rollers 21Y, 21M, 21C, and 21K are then exposed by laser beams modulated according to image data of the respective colors Y, M, C, and K and emitted from the writing unit 4. Accordingly, electrostatic latent images are formed on the surfaces of the respective image carrying members 2Y, 2M, 2C, and 2K. The electrostatic latent images are then developed by the development devices 21Y, 21M, 21C, and 21K, and are formed into toner images of the respective colors Y, M, C, and K.

Meanwhile, one of the recording mediums P stored in a selected one of the sheet-feeding units 12 and 13 is separated from the others of the recording mediums P by a corresponding one of the sheet-feeding rollers 24 and 25. The thus separated recording medium P is conveyed to the registration roller pair 26 located at an upstream position of the image forming unit 3Y in the sheet-feeding direction. The registration roller pair.26 sends the recording medium P onto the transfer belt 5, which moves in a direction indicated by an arrow B in FIG. 1, at an appropriate timing so that toner images carried on the image carrying members 2Y, 2M, 2C, and 2K are aligned with the recording medium P. Thus, the recording medium P is conveyed onto the transfer belt 5 through a nip formed by the driven roller 8 and the sheet-adhering roller 10. Electrostatically adhered to the outer surface of the transfer belt 5 by the bias voltage applied to the sheet-adhering roller 10, the recording medium P is sent to the respective image forming units 3Y, 3M, 3C, and 3K, where the toner images are transferred to the recording medium P.

When the recording medium P sequentially passes the image forming units 3Y, 3M, 3C, and 3K, the toner images of the respective colors Y, M, C, and K carried on the image carrying members 2Y, 2M, 2C, and 2K are sequentially superimposed and transferred to the recording medium P. As a result, a full-color toner image including the toner images of the four colors is formed on the recording medium P. The full-color toner image is then fixed on the recording medium P by the fixing unit 11. Thereafter, the recording medium P is conveyed through a sheet-conveying path according to a selected mode, reversed, and discharged onto the sheet-discharging tray 18. Alternatively, the recording medium P may be conveyed from the fixing unit 11 to the reversing unit 15 and the duplex unit 14, and sent back to the image forming units 3Y, 3M, 3C, and 3K at predetermined timing. After the toner images are transferred from the image carrying members 2Y, 2M, 2C, and 2K to the recording medium P, toner remaining on the image carrying members 2Y, 2M, 2C, and 2K is collected by the respective cleaning devices 23Y, 23M, 23C, and 23K and sent toward a waste toner conveying coil 232M. The toner is conveyed by the waste toner conveying coil 232M to a waste toner drain port and deposited in a waste toner bottle (not illustrated).

To form a monochrome image on the recording medium P, a toner image is formed on the image carrying member 2K in the image forming unit 3K by using the black toner. Then, the recording medium P is conveyed by the transfer belt 5 in an appropriate timing for transferring the black toner image to the recording medium P. Accordingly, the metronome image is transferred to the recording medium P.

The image forming units 3Y, 3M, 3C, and 3K form process cartridges detachably provided in the image forming apparatus 1. As illustrated in FIG. 2, the image forming unit 3M integrally includes the image carrying member 2M, the charging roller 21M, the charging-roller cleaning roller 210M, the development device 22M, and the cleaning device 23M. Since the image forming units 3Y, 3M, 3C, and 3K are configured to be attached to and detached from the image forming apparatus 1, the image forming units 3Y, 3M, 3C, and 3K can be individually replaced by new ones. As a result, the image forming apparatus 1 according to the present embodiment can be well maintained.

As described above, the image forming units 3Y, 3M, and 3C are common in structure. Specifically, the image forming units 3Y, 3M, and 3C are shipped, with the development devices 22Y, 22M, and 22C included in the image forming units 3Y, 3M, and 3C containing carrier but not toner. Compared with the image forming units 3Y, 3M, and 3C, the image forming unit 3K for forming black toner images is made higher in durability and reliability, since the image forming unit 3K is used more frequently than the other image forming units 3Y, 3M, and 3C. For example, components such as the image carrying member 2K and the carrier of the development device 22K in the image forming unit 3K are formed by materials of increased durability, compared with counterparts of the other image forming units 3Y, 3M, and 3C. Further, the development device 22K in the image forming unit 3K is formed in a larger size than the development devices 22Y, 22M, and 22C in the other image forming units 3Y, 3M, and 3C so that the development housing 221K of the development device 22K can contain a larger amount of toner. Therefore, the development device 22K of the image forming apparatus 3K contains a predetermined amount of the black toner in advance at the time of shipping. Thus, the image forming apparatus 3K is shipped, with the toner density of the toner included in the development deice 22K adjusted.

Figure 4:
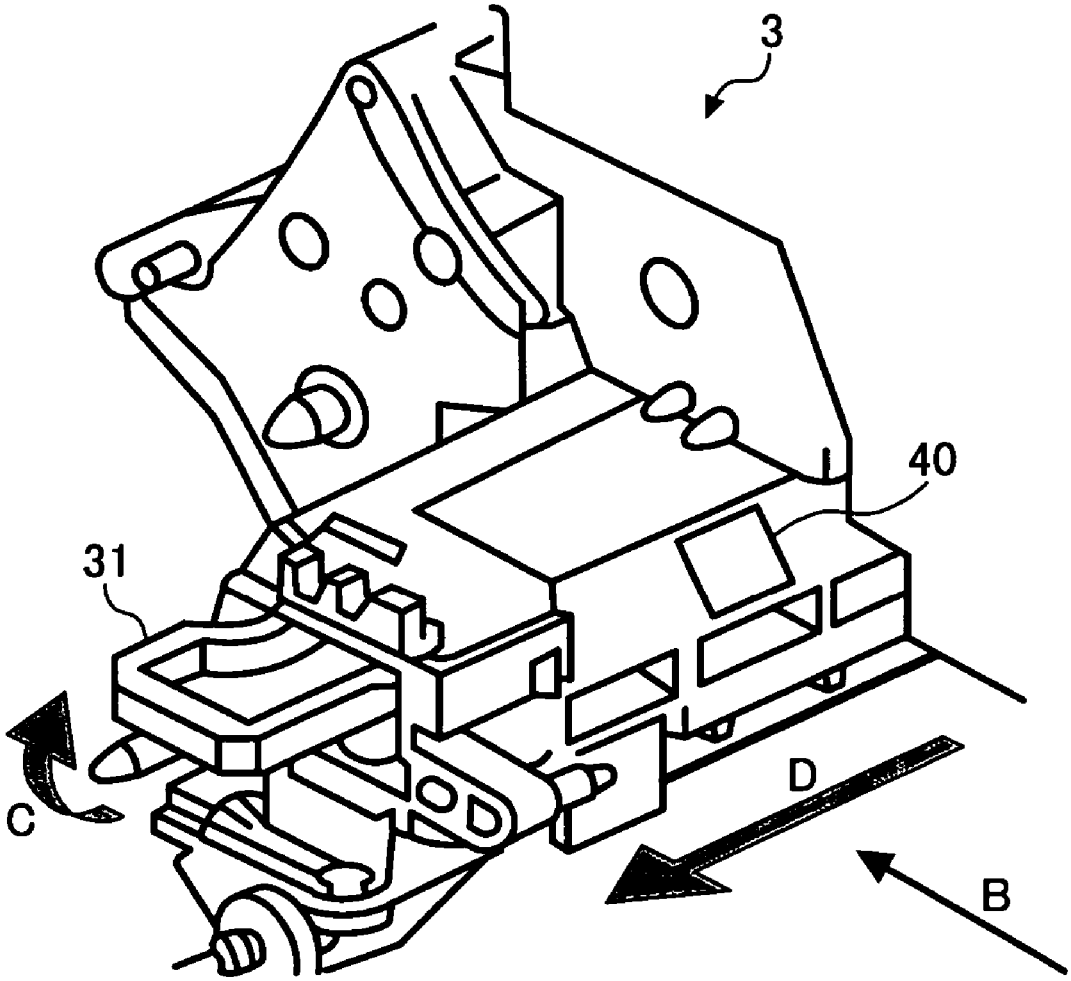
FIG. 4 is a perspective view of the image forming unit illustrated in FIG. 2, as being detached from the image forming apparatus illustrated in FIG. 1.

FIG. 4 illustrates a perspective view of an image forming unit 3 (i.e., image forming units 3Y, 3M, 3C, and 3K), as being pulled out from the image forming apparatus 1.

To pull out the image forming apparatus 3 from the image forming apparatus 1, a lever 31 is pulled down toward a front side (i.e., an opposite direction to a direction indicated by an arrow C in FIG. 4). Accordingly, the image forming unit 3 is easily pulled out toward a direction indicated by an arrow D. When the image forming unit 3 is attached to the image forming apparatus 1, the lever 31 is folded upward, i.e., in the direction indicated by the arrow C in FIG. 4.

In FIG. 4, an IC tag 40 is attached to a right wall of the image forming unit 3. The IC tag 40 is formed by mounting an IC chip 41 (see FIG. 5) on a printed board. The IC chip 41 includes an EEPROM (electrically erasable and programmable read only memory) 42 which is a non-volatile memory. The EEPROM 42 stores data of image forming conditions such as an exposure amount, a charge level, a development bias voltage, and so forth, as information necessary for controlling the image forming unit 3 and components thereof. For each of the image forming units 3Y, 3M, 3C, and 3K (i.e., a process cartridge), the EEPROM 42 further stores a cartridge lot, production date (i.e., year, month, and day), type, storage period, usable life, used time, use guarantee time, identification number, first-use date (i.e., year, month, and day), number of output copies, limit number of coping operations, number of recycling operations, and limit number of recycling operations. The EEPROM may further store information about abnormal conditions of the image forming unit 3, such as abnormalities in the T-sensor and a charging condition, which is used in a checking operation of a recycling process and also used for determining whether or not a component of the image forming unit 3 should be replaced with a new one. The EEPROM still further stores an initial-setting-end flag.

Figure 5:
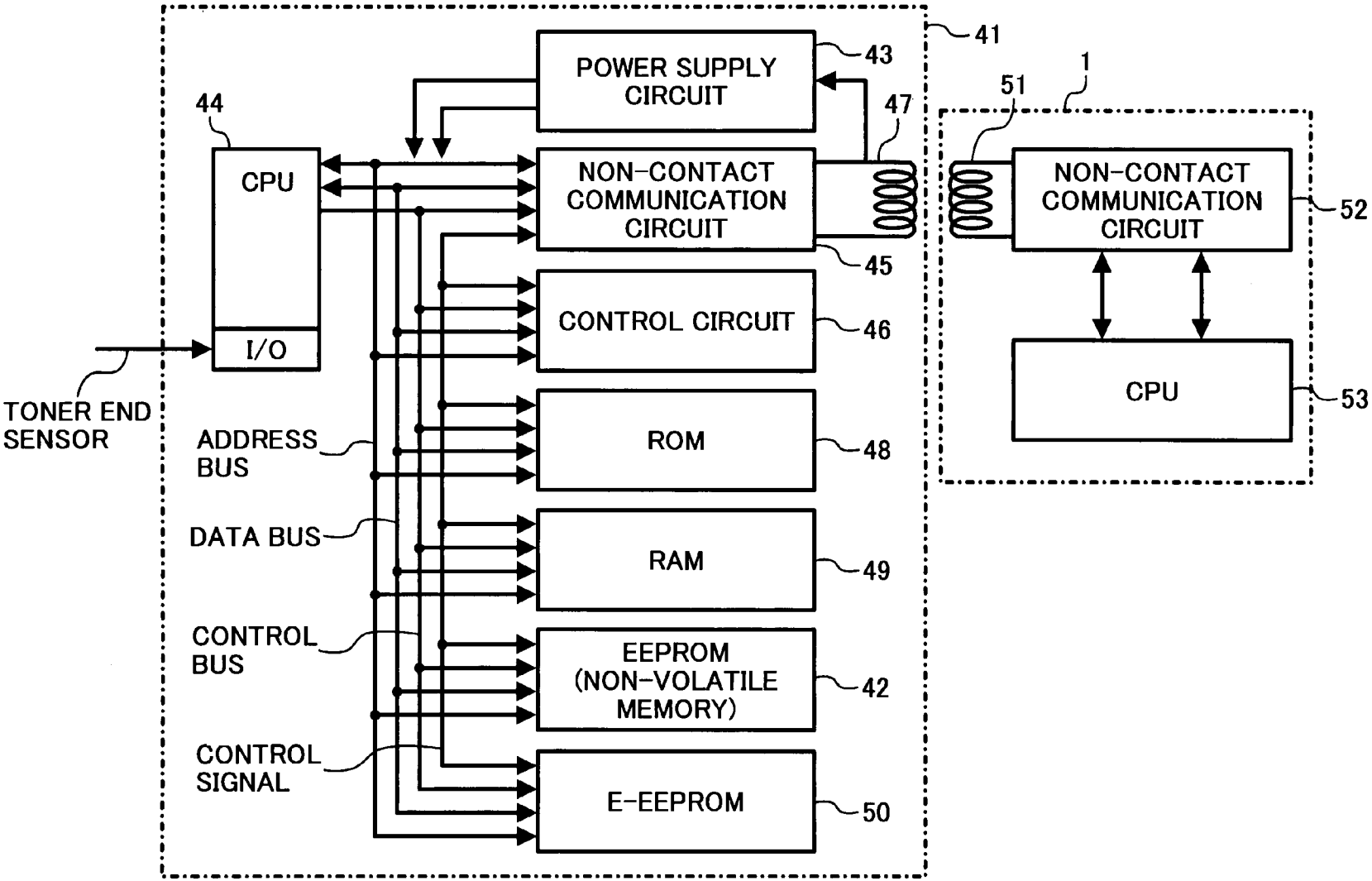
FIG. 5 is a block diagram illustrating a relationship between the image forming apparatus illustrated in FIG. 1 and a non-contact type IC chip mounted on an IC tag.

FIG. 5 is a block diagram illustrating a relationship between the image forming apparatus 1 and the IC chip 41 mounted on the IC tag 40. The IC chip 41 used in this example is non-contact type IC chip. The IC chip 41 includes a power supply circuit 43, a CPU (central processing unit) 44, a non-contact communication circuit 45, a control circuit 46, a transceiving antenna 47, a ROM (read only memory) 48, a RAM (random access memory) 49, the EEPROM 42, and an E-EEPROM 50. The transceiving antenna 47 performs non-contact communication with the image forming apparatus 1. The power supply circuit 43 rectifies electromagnetic waves of the transceiving antenna 47 and supplies power to the above circuits. The ROM 48 is a program memory, and the RAM 49 is a working memory for executing a program. The EEPROM 42 is a non-volatile memory for storing information necessary for controlling the image forming unit 3. The E-EEPROM 50 stores a command exclusively for writing data on the EEPROM 42. The CPU 44 is provided with an I/O (input/output) port for receiving an output from the toner-end sensor.

The image forming apparatus 1 includes a transceiving antenna 51, a non-contact communication circuit 52, and a CPU 53. Signals are transmitted between the non-contact communication circuit 52 and the CPU 53 through a serial communication interface.

The IC tag 40 described above is included in each of the image forming units 3Y, 3M, 3C, and 3K as IC tags 40Y, 40M, 40C, and 40K, respectively. Correspondingly, the image forming apparatus 1 has four non-contact communication circuits 52.

Non-contact communication between the image forming apparatus 1 and the IC tag 40 in the image forming unit 3 is carried out as follows. First, a signal output from the CPU 53 is sent to the non-contact communication circuit 52 in the image forming apparatus 1. The signal is then modulated to a predetermined signal in the non-contact communication circuit 25, and sent to the transceiving antenna 51. The transceiving antenna 51 sends the signal to the transceiving antenna 47 of the IC chip 41. The non-contact communication circuit 45 demodulates the predetermined signal which has been modulated for transmission. Then, the predetermined signal is converted into a parallel signal and sent to the CPU 44. The CPU 44 reads data from the EEPROM 42 according to the signal sent from the image forming apparatus 1, performs arithmetic processing based on a predetermined program stored in the ROM 48, and writes a result of the arithmetic processing on the EEPROM 42. The result of the arithmetic processing is also sent to the image forming apparatus 1 from the CPU 44 of the IC chip 41 through the non-contact communication circuit 45.

The IC tag 40 described above is a non-contact type IC tag. Alternatively, the IC tag 40 may be a contact-type IC tag. The contact-type IC tag 40 is similar in structure to the non-contact type IC tag 40 except that the transceiving antennas 47 and 51 are replaced by contact terminals in the case of the contact-type IC tag 40.

Figure 6:
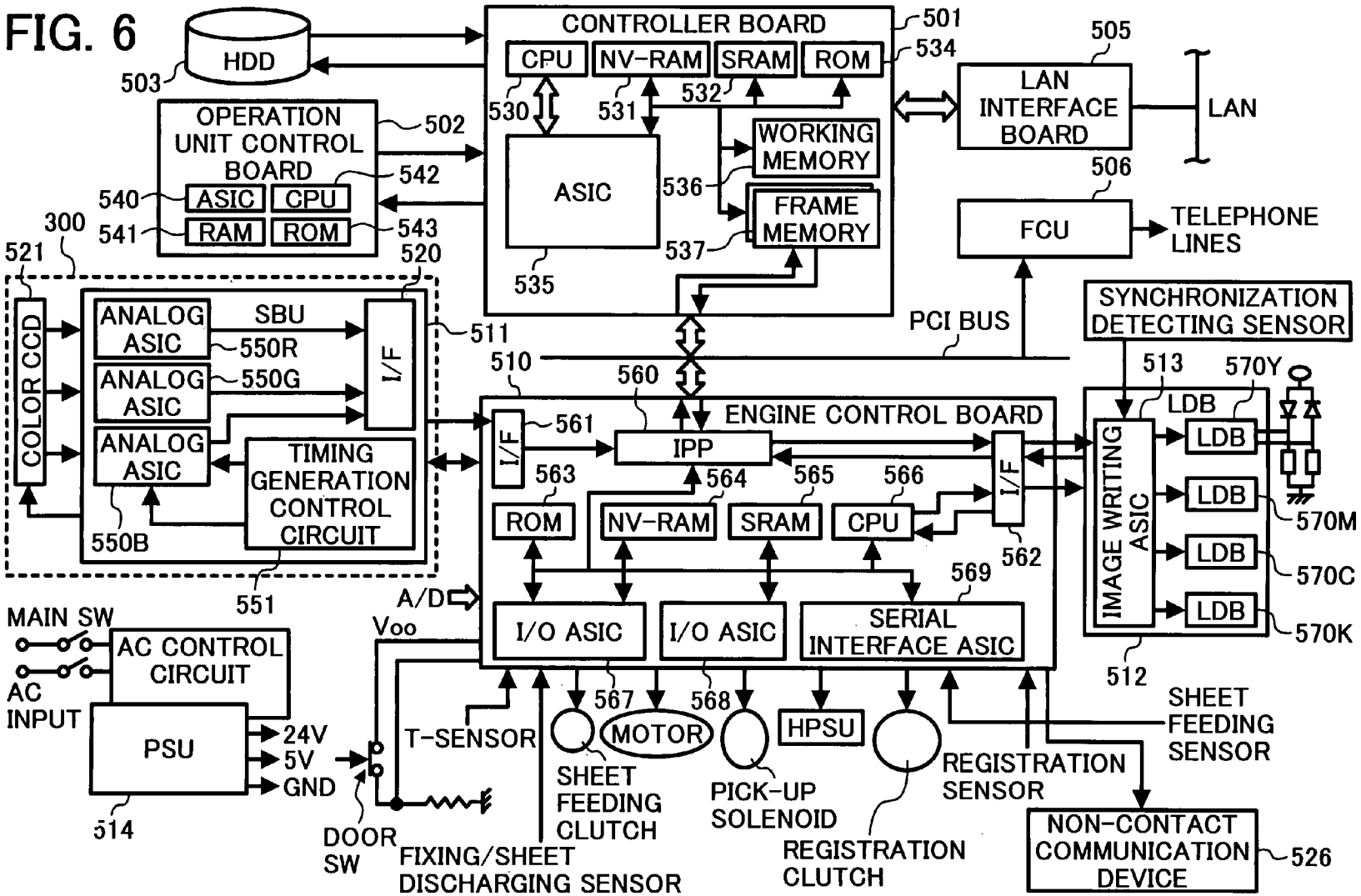
FIG. 6 is a block diagram illustrating a system configuration of the image forming apparatus illustrated in FIG. 1.

FIG. 6 is a block diagram illustrating a system configuration of the image forming apparatus 1. The image forming apparatus 1 illustrated in FIG. 6 includes a controller board 501, an operation unit control board 502, an HDD (hard disk drive) 503, a LAN (local area network) interface board 505, an FCU (facsimile control unit) 506, an engine control board 510, an SBU (scanner board unit) 511, and an LDB (laser diode control board) 512. The controller board 501 controls the entire image forming apparatus 1 and is connected to the operation unit control board 502. The HDD 503 stores image data. The SBU 511 is connected to the engine control board 510 and reads image data of an original document. The LDB 512 writes the image data on the image carrying member 2. A PSU (power supply unit) 514 supplies power for controlling the image forming apparatus 1. As a main switch is turned on, the PSU 514 is supplied with commercial power. The SBU 511 is included in a scanning unit 300 which optically scans an image formed on the original document while lights are applied on the original document so that the image of the original document is formed on a color CCD (charge-coupled device) 521. The color CCD 521 photoelectrically converts the reflected light of the light applied on the original document into RGB image signals of even and odd channels.

The controller board 501 includes a plurality of application functions such as a scanner application, a facsimile application, a printer application, and a copier application, and controls the entire system of the image forming apparatus 1. The controller board 501 includes a CPU 530, a ROM 534, a SRAM (static random access memory) 532, an NV-RAM (non-volatile random access memory) 531, an ASIC (application specific integrated circuit) 535, a frame memory 537, a working memory 536, and interface circuits (not illustrated). The ROM 534 controls the controller board 501. The SRAM 532 is a working memory used by the CPU 530. The NV-RAM 531 includes a timer (not illustrated) and a lithium battery (not illustrated) and has a function of backing up the SRAM 532. The ASIC 535 controls peripheries of the CPU 530, such as a system bus (not illustrated), the frame memory 537, and an FIFO (first-in first-out) memory provided in the controller board 501. The timer included in the NV-RAM 531 generates a date and time by counting a reference clock of a crystal oscillator running at 32768 Hz. The date and time input by the operation unit control board 502 is set by the CPU 530 of the controller board 501 in an internal register included in the NV-RAM 531. The date and time thus set are used thereafter every time the power supply to the image forming apparatus 1 is turned on, for determining until what date (i.e., year, month, and day) the image forming unit 3 can continue to be used (i.e., the use limit date). The first-use date of an image forming unit 3 newly installed in the image forming apparatus 1 may be sent to the NV-RAM 531 and used in calculation of a use time of the image forming unit 3.

The operation unit control board 2 controls an input operation performed by a user for system setting. The user performs the input operation by operating an operation panel (not illustrated) provided on the image forming apparatus 1. The operation unit control board 502 further controls display of a message informing the user of settings and conditions of the system. The operation unit control board 502 includes an LCD (liquid crystal display, not illustrated), an LCDC (liquid crystal display controller) 540, a RAM 541, a CPU 542, and a ROM 543. The RAM 541 is a working memory used by the CPU 542. The ROM 543 stores a program for controlling the operation unit control board 502, and controls reading of inputs in the operation unit control board 502 and outputting a display message to the operation unit control board 502. The LCDC 540 controls the LCD which displays the settings and conditions of the system. The LCDC 540 further controls key inputs performed by the user.

The HDD 503 is used as an application database for storing application programs of the system and data of image forming devices used in the image forming apparatus 1. The HDD 503 is used also as an image database for storing image data such as data of an image read out and an image to be written, as well as document data. The HDD 503 is connected to the controller board 501 by a physical interface, an electrical interface, and an interface in conformity to ATA/ATAPI-4 (AT attachment with packet interface).

The LAN interface board 505 is connected to the controller board 501 by standard communication interfaces, such as a PHY (physical) chip I/F and an interface sold under a trademark I2C BUS INTERFACE. The LAN interface board 505 serves as a communication interface board connecting a LAN (e.g., the Internet) and the controller board 501. Therefore, the controller board 501 communicates with an external apparatus thorough the LAN interface board 505.

The FCU 506 is connected to the controller board 501 by a general-purpose PCI (peripheral component interface) bus. The PCI bus is an image data bus/control command bus for transmitting image data and a control command in a time-sharing manner.

The engine board 510 is connected to the controller board 501 by the PCI bus, and mainly controls image forming process of the image forming apparatus 1. The engine board 510 includes an IPP (internet protocol processor) 560, an I/C 561, an I/C 562, a ROM 563, a NV-RAM 564, an SRAM 565, a CPU 566, an I/O ASIC (input/output application specific integrated circuit) 567, an I/O ASIC 568, and a serial interface ASIC 569. The ROM 563 stores programs necessary for controlling a copying operation, a printing operation, and so forth. The SRAM 565 controls the ROM 563. The IPP 560 is a programmable arithmetic processing device for performing image processing. Specifically, the IPP 560 performs such operations as separational generation (i.e., image segmentation for determining whether a target image is a character region or a photo region), RTT (real time thresholding), scanner gamma conversion, filtering, color correction, scaling, image processing, printer gamma conversion, and gradation processing. The NV-RAM 564 includes an SRAM and a memory which detects power-off of the image forming apparatus 1 and stores the information in an EEPROM. The serial interface ASIC 569 exchanges signals with the CPU 566 which performs various control operations. The I/O ASICS 567 and 568 control I/Os located near the engine board 510, such as a counter, a fan, and a solenoid. The I/O ASICS 567 and 568 further perform I/O control of the image forming apparatus 1, including control of a motor controlling the image forming apparatus 1, and control of high-voltage power supplies (indicated as HPSU in FIG. 6), such as a charging bias voltage, a development bias voltage, and a transfer bias voltage used for the image forming operation. Furthermore, the I/O ASICS 567 and 568 perform I/O control of the image forming apparatus 1, including analog control of such devices as a pick-up solenoid, a sheet-feeding clutch, and a registration clutch used for conveying the recording medium P, and such sensors as a registration sensor, a sheet-discharge sensor, the toner-end sensor, the P-sensor, and the T-sensor.

A non-contact communication device 526 shown in FIG. 6 is a communication circuit which communicates with the IC tag 40 of the image forming unit 3, which includes the non-volatile memory (i.e., EEPROM 42). The non-contact communication device 526 exchanges signals with the CPU 566 via the serial interface ASIC 569. When a door switch connected to an I/O of the engine control board 510 is in an "OFF" state, the CPU 566 checks if the image forming unit 3 has been replaced with a new one.

The SBU 511 includes analog ASICs 550R, 550G, and 550B, a timing generation/control circuit 551, and an output interface (I/F) 520. The RGB image signals output from the color CCD 521 are first subjected to sampling holding in sampling holding circuits (not illustrated) of the respective analog ASICs 550R, 550G, and 550B, and then to A/D (analog-to-digital) conversion. Thereafter, the RGB image signals are converted into data signals and subjected to shading correction in the respective analog ASICs 550R, 550G, and 550B. The RGB image signals are then sent to the IPP 560 of the engine control board 510 via an image data bus of the output I/F 520. The RGB image data thus sent from the SBU 511 to the IPP 560 is corrected of signal degradation caused due to quantization of the read image data to optical and digital signals (i.e., signal deterioration of a scanner system). Therefore, the RGB image data is corrected of the signal deterioration and written on the frame memory 537 of the controller board 501 via an image data bus of the PCI bus.

The LDB 512 includes an image writing ASIC 513 and LDBs 570Y, 570M, 570C, and 570K. Write signals of the respective colors Y, M, C, and K output from the working memory 536 of the controller board 501 are input in the respective LDBs 570Y, 570M, 570C, and 570K of the LDB 512, which are LD writing circuits. The LDBs 570Y, 570M, 570C, and 570K perform LD current control (i.e., modulation control), and LDs of the respective colors M, C, and K are output to write images on the surfaces of the respective image carrying members 2Y, 2M, 2C, and 2K.

Figure 7:
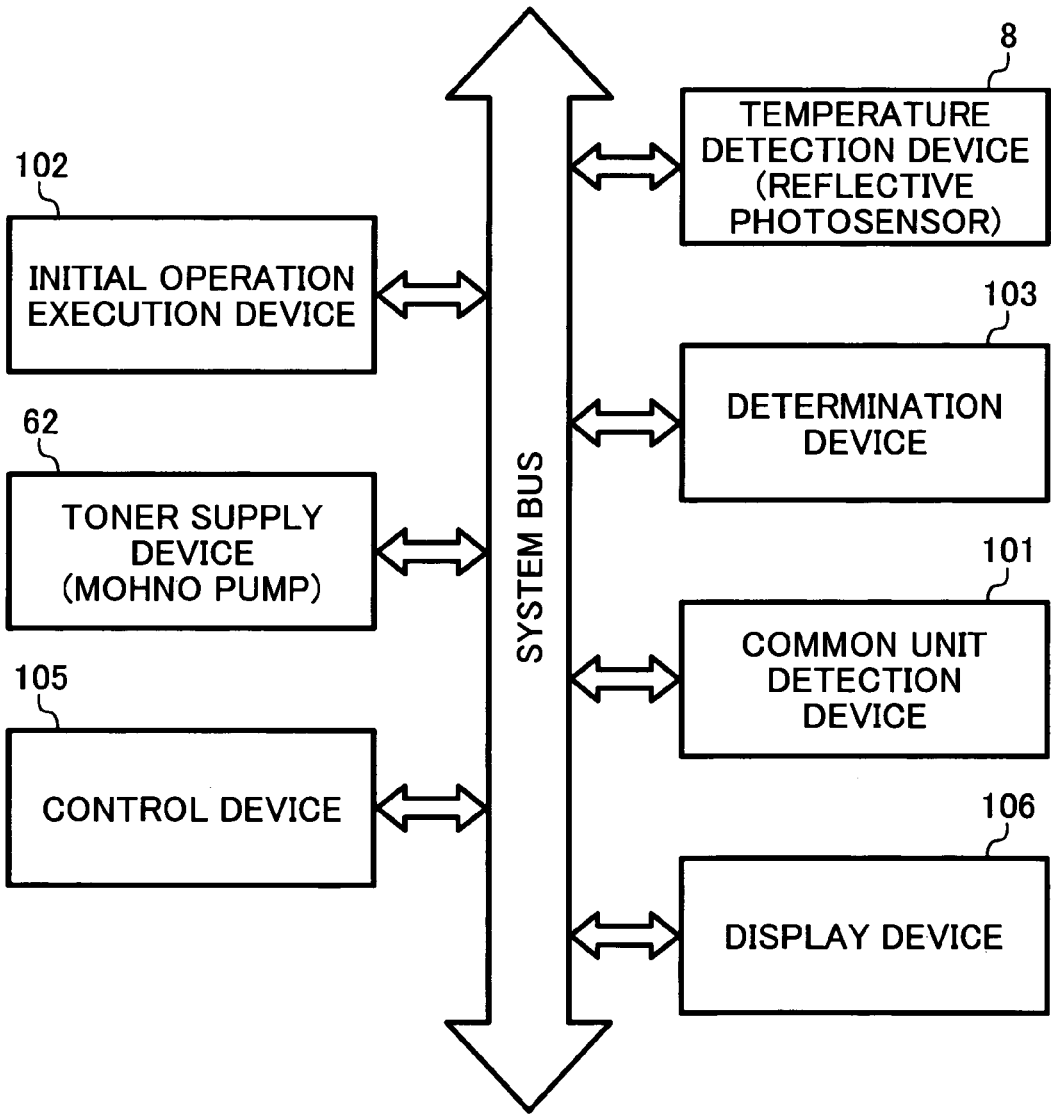
FIG. 7 is a block diagram illustrating a control of an initial operation of the image forming apparatus illustrated in FIG. 1.

With reference to the block diagram of FIG. 7, description is made on an initial operation performed when the image forming unit 3 (i.e., process cartridge) is replaced with a new one. As illustrated in FIG. 7, the initial operation involves a common-unit detection device 101, an initial operation execution device 102, a determination device 103, control device 105, a display device 106, a density detection device (i.e., the P-sensor) 28, and a toner supply device (i.e., the mohno pump) 62.

As illustrated in FIG. 7, the common-unit detection device 101 has a function of detecting whether or not any of the common image forming units 3Y, 3M, and 3C is installed in the image forming apparatus 1. The CPU 566 of the engine control board 510 and the non-contact communication device 526 form the common-unit detection device 101, and perform a common-unit detection execution program stored in the ROM 563 (i.e., Steps S8 and S9 of an initial operation described later).

The determination device 103 has a function of determining whether or not the toner in the development device 22 is at a predetermined charge level after the initial operation is performed, and determining, based on a result of the detection, whether or not a toner mixing operation should be performed again. The CPU 566 of the engine control board 510 and the density detection device (i.e., the P-sensor) 28 form the determination device 103, and perform a determination execution program stored in the ROM 563 (i.e., Steps S15 and S16 of the initial operation described later).

The initial operation execution device 102 has a function of executing the initial operation to any of the common image forming units 3Y, 3M, and 3C detected by the common-unit detection device 101 to be installed in the image forming apparatus 1. The CPU 566 of the engine control board 510 and the toner supply device (i.e., the mohno pump) 62 form the initial operation execution device 102, and perform an initial operation execution program stored in the ROM 563 (i.e., Steps S11 to S14 of the initial operation described later).

The control device 105 has a function of detecting whether or not the door of the image forming apparatus 1 is opened, and whether or not the power supply of the image forming apparatus 1 is switched from the "OFF" state to the "ON" state. The control device 105 further has a function of displaying, on the display device 106 of the image forming apparatus 1, a message indicating that the initial operation is in progress. The control device 105 has another function of detecting whether or not the non-common image forming unit 3K is installed at a predetermined position in the image forming apparatus 1. Furthermore, the control device 105 has other functions of setting the initial-setting-end flag in the EEPROM 42 of the IC chip 41 in the image forming unit 3, and writing a toner identification number in the EEPROM 42. The above described functions are performed by the CPU 566 of the engine control board 510 by executing programs for the respective functions, which are stored in the ROM 563.

Figure 8A:
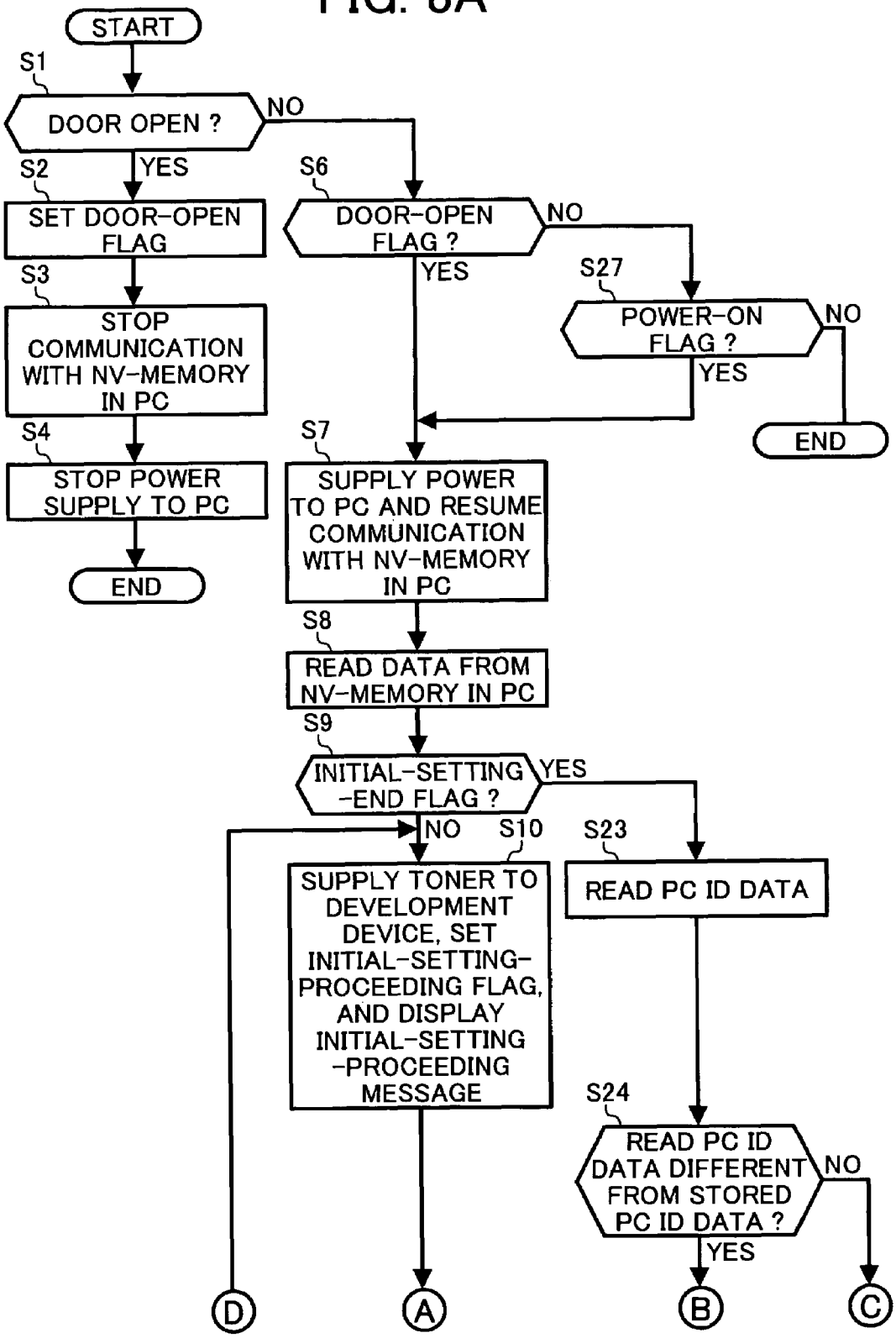
FIGS. 8A and 8B are a flowchart illustrating an example procedure of an initial setting operation of the image forming apparatus illustrated in FIG. 1.
Figure 8B:
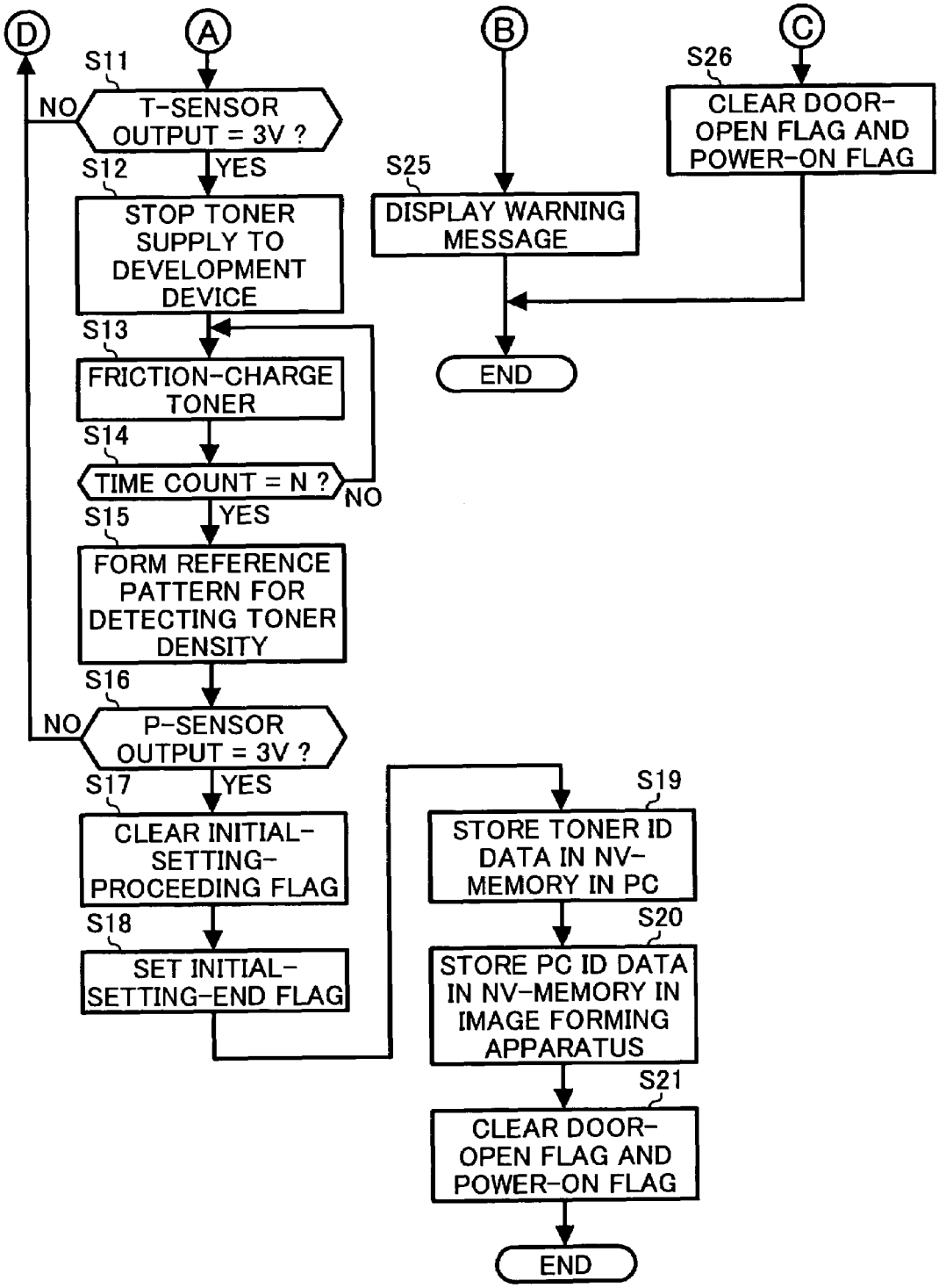

With reference to a flowchart of FIGS. 8A and 8B, description is made on an initial operation performed in the replacement of the image forming unit 3 (indicated as PC in the figure) with a new one.

In the initial operation, it is first checked whether or not the door of the image forming apparatus 1 is open (Step S1). If it is determined that the door is open (YES in Step S1), a door-open flag is set (Step S2). Thereafter, communication with the EEPROM 42 (i.e., the non-volatile memory) included in each of the image forming units 3Y, 3M, 3C, and 3K is stopped (Step S3). Then, power supply to the image forming units 3Y, 3M, 3C, and 3K is stopped (Step S4), and the initial operation ends.

Meanwhile, if it is determined that the door is not open (NO in Step S1), it is checked whether or not there is the door-open flag (Step S6). If it is determined that there is not the door-open flag (NO in Step S6), it is checked whether there is a power-ON flag (Step S27). The power-ON flag is set when the image forming apparatus 1 is powered on. If it is determined that there is not the power-ON flag (NO in Step S27), the initial operation ends.

If there is the door-open flag (YES in Step S6), or if there is the power-ON flag (YES in Step S27), power is supplied to the image forming units 3Y, 3M, 3C, and 3K, and the communication with the EEPROM 42 included in each of the image forming units 3Y, 3M, 3C, and 3K is resumed (Step S7). Thereafter, data stored in the EEPROM 42 included in each of the image forming units 3Y, 3M, 3C, and 3K is read (Step S8). Then, it is checked whether or not the initial-setting-end flag is set (Step S9). If the initial-setting-end flag is not set in the EEPROM 42 of any one of the image forming units 3Y, 3M, 3C, and 3K (NO in Step S9), the any one of the image forming units 3Y, 3M, 3C, and 3K is determined as a common image forming unit including a development device not supplied with toner. Therefore, an initial setting operation is performed to the any one of the image forming units 3Y, 3M, 3C, and 3K.

Specifically, if the initial-setting-end flag is not set in the EEPROM 42 of any one of the image forming units 3Y, 3M, 3C, and 3K, toner is supplied into the development device 22 of the any one of the image forming units 3Y, 3M, 3C, and 3K from a corresponding one of the toner cartridges 30Y, 30M, 30C, and 30K. Further, communication with the EEPROM 42 is performed, and an initial-setting-proceeding flag is set. Also, the display device 106 of the image forming apparatus 1 displays a message indicating that the initial setting operation is proceeding (Step S10). Then, it is checked whether or not a voltage output from the T-sensor has reached a predetermined value (e.g., 3 volts) (Step S11). Toner continues to be supplied to the development device 22 until the voltage output from the T-sensor reaches the predetermined value. If the voltage output from the T-sensor reaches the predetermined value (YES in Step S11), the toner supply to the development device 22 is stopped (Step S12). Then, the conveying screws 222 and 223 in the development device 22 are rotated to friction-charge the toner contained in the development device 22 (Step S13). When the conveying screws 222 and 223 start rotating, time counting starts until a time count reaches a predetermined number N (N is a positive integral number) (Step S14). If the time count reaches the predetermined number N (YES in Step S14), the initial setting operation ends.

Then, it is determined whether or not the toner mixing operation should be performed again. Specifically, a reference image pattern is formed on the surface of the image carrying member 2 for detecting a density of the image (Step S15). Then, the P-sensor detects the reference image pattern to check whether or not a voltage output from the P-sensor is of a predetermined value (e.g., 3 volts) (Step 16). If the voltage output from the P-sensor is not the predetermined value (NO in Step 16), the toner in the development device 22 is not at the predetermined value. Therefore, the steps S10 to S15 are performed again. In this process, a toner supply amount and a toner mixing time are set based on the voltage output from the P-sensor. Meanwhile, if the voltage output from the P-sensor is of the predetermined value (YES in Step 16), the toner in the development device 22 has been charged to a value high enough to perform a desirable image forming operation. Therefore, the initial operation proceeds to a next step.

If it is determined that the voltage output from the P-sensor is the predetermined value and thus the toner mixing operation is unnecessary (YES in Step S16), the initial-setting-proceeding flag set in the EEPROM 42 at Step S10 is cleared (Step S17), and the initial-setting-end flag is instead set in the EEPROM 42 (Step S18). Then, such data as the color of toner supplied to the development device 22 of the image forming unit 3 and the first-use date of the image forming unit 3 is stored in the EEPROM 42 of the image forming unit 3 (Step S19). Further, data for identifying the image forming unit 3 (i.e., ID data of the image forming unit 3), such as a lot number, a serial number, a production date, and a manufacturer, is read from the EEPROM 42 of the image forming unit 3. The ID data of the image forming unit 3 is then stored in the NV-RAM (non-volatile memory) 531 of the image forming apparatus 1 in association with a position of the image forming unit 3 within the image forming apparatus 1 (Step S20). Thereafter, the door-open flag and the power-ON flag are cleared (Step S21), and the initial operation ends.

As for a non-common image carrying unit, there is the initial-setting-end flag in the EEPROM 42 in the non-common image forming unit 3, i.e., toner is already supplied in its development device 22 (YES in Step S9). In this case, ID data of the non-common image forming unit 3 is read from the EEPROM 42 of the image forming unit 3 to check whether or not the non-common image forming unit 3 is inappropriately installed in the image forming apparatus 1 (Step S23). The ID data thus read from the EEPROM 42 of the non-common image forming unit 3 is compared with the ID data stored in the NV-RAM 531 of the image forming apparatus 1 in association with the position of the non-common image forming unit 3 within the image forming apparatus 1 (Step S24). If it is determined, based on a result of the comparison, that the two ID data sets are different from each other (YES in Step S24), the display device 106 of the image forming apparatus 1 displays a warning message indicating that the non-common image forming unit 3 is inappropriately installed (Step S25), and the initial operation ends.

Meanwhile, if it is determined, based on the comparison result, that the two ID data sets are identical (NO in Step S24), the door-open flag and the power-ON flag are cleared (Step S26), and the initial operation ends.

The image forming unit 3 according to the present embodiment includes the image carrying member 2 and the development device 22. However, the configuration of the image forming unit 3 is not limited to the above. For example, the image forming unit 3 may exclusively include the development device 22. In this case, the IC tag 40 including the EEPROM 42 may be provided on the development device 22 so that the initial operation described above is performed at a time of replacement of the development device 22.

Further, in the present embodiment, the image forming units 3Y, 3M, and 3C are the common image forming units having similar structures. Alternatively, all of the image forming units 3Y, 3M, 3C, and 3K may be configured to having similar structures.

Furthermore, in the image forming unit 3 according to the present embodiment, the toner density of the toner contained in the development device 22 is detected by the T-sensor. Alternatively, the toner density may be detected from the time spent for supplying toner to the development device 22.

Further, in the image forming unit 3 according to the present embodiment, a reference image pattern is formed on the surface of the image carrying member 2, and the density of the reference image pattern is detected to determine whether or not the toner in the development device 22 is charged to a predetermined level. The detection of the toner density is not, however, limited to the above. For example, a power supply circuit for applying a transfer bias voltage to the transfer brush 9 may be provided with a current detection circuit which detects a value of transfer current generated when the toner in the reference image pattern formed on the surface of the image carrying member 2 moves onto the recording medium P. Based on the transfer current value thus detected, it can be determined whether or not the toner in the development device 22 is charged to the predetermined level. Still alternatively, whether or not the toner in the development device 22 is charged to the predetermined level may be determined based on a value of development current generated when toner moves from the surface of the development roller 220 onto the surface of the image carrying member 2 when the latent image formed on the surface of the image carrying member 2 is developed.

According to the image forming apparatus 1 of the present embodiment, the initial operation performed in the replacement of the image forming unit 3 continues to be performed until the toner density of the reference image pattern reaches a desirable value. Therefore, even if friction chargeability of the toner changes due to such factors as an environmental factor, the toner in the image forming unit 3 can be charged to a predetermined level in the initial operation. Thus, deterioration in image quality occurring in an image formed at an early stage of an image forming operation can be reduced.

Further, according to the image forming apparatus 1 of the present embodiment, the reference image pattern (i.e., a toner image) is formed on the image carrying member 2, and the toner density of the reference image pattern is detected by the toner density detection device. Based on the thus detected toner density, whether or not the toner in the development device 22 is charged to a predetermined level is detected. If the charge level of the toner is not the predetermined charge level, the toner density of the reference image pattern cannot be obtained. Therefore, whether or not the charge level of the toner in the development device 22 is the predetermined charge level can be determined by detecting the toner density of the reference pattern.

The image forming apparatus 1 according to the present embodiment includes the non-volatile memory (i.e., the EEPROM 42), and information stored in the non-volatile memory is used for determining whether a common image forming unit 3 is installed in the image forming apparatus 1. Thus, by reading the information stored in the non-volatile memory of the image forming unit 3 at a predetermined timing (e.g., upon opening of the door of the image forming apparatus 1, and upon power-on of the image forming apparatus 1), it can be determined whether the image forming unit 3 installed in the image forming apparatus 1 is a common image forming unit or a non-common image forming unit having a development device supplied with toner.

According to the image forming apparatus 1 of the present embodiment, when the determination device determines that the toner mixing operation is unnecessary, information that the initial setting operation has completed is stored in the non-volatile memory of the image forming unit 3. Accordingly, the non-volatile memory stores information that the initial setting operation has been performed only to the image forming unit 3 which includes the development device 22 containing the toner charged to the predetermined level. Therefore, at the predetermined timing such as upon opening of the door of the image forming apparatus 1 and upon power-on of the image forming apparatus 1, detection is made as to whether or not the information that the initial setting operation has completed is stored in the non-volatile memory of an image forming unit 3 installed in the image forming apparatus 1. Thus, it can be determined whether the image forming unit 3 is a common image forming unit or a non-common image forming unit having a development device supplied with toner in the initial setting operation.

Further, according to the image forming apparatus 1 of the present embodiment, when an image forming unit 3 installed in the image forming apparatus 1 is detected by the common-unit detection device 101 as a non-common image forming unit, whether or not the image forming unit 3 is installed at a predetermined position within the image forming apparatus 1 is determined. Accordingly, the image forming unit 3M, for example, is prevented from being inappropriately installed at a position of the image forming unit 3Y, for example. That is, installing of the image forming unit 3 at the inappropriate position can be prevented.

The image forming unit 3K, which includes the black toner, is used more frequently than the image forming units 3Y, 3M, and 3C of the other toner colors. Therefore, components and the toner tend to be exhausted more quickly in the image forming unit 3K than in the other image forming units 3Y, 3M, and 3C. Therefore, if the image forming unit 8K for the black toner has a similar structure to the other common image forming units 3Y, 3M, and 3C, the image forming unit 3K is needs to be replaced more frequently than the other image forming units 3Y, 3M, and 3C. According to the image forming apparatus 1 of the present embodiment, therefore, the image forming unit 3K for the black toner has a different structure from the other image forming units 3Y, 3M, and 3C. For example, the image forming unit 3K is formed by components of higher durability and provided with a development device 22K having a larger toner containing space than the other image forming units 3Y, 3M, and 3C. As a result, durability of the image forming unit 3K for the black toner is improved, and thus the image forming unit 3K needs not to be frequently replaced.

The image forming apparatus 1 according to the present embodiment has the detection device (i.e., the T-sensor) for detecting the toner density of the toner contained in the development device 22. The T-sensor detecting the toner density of the toner contained in the development device 22, so that the toner density of the toner contained in the development device 22 is kept at a predetermined level. Accordingly, the toner density of images formed on the recording medium P is preferably kept.

In the image forming apparatus 1 according to the present embodiment, toner supply is controlled based on the result of detection by the toner density detection device. Specifically, when the toner density detection device detects that the toner density of the toner contained in the development device 22 is below the predetermined level, the mohno pump 62 functioning as a toner supply device is driven to supply the toner in the development device 22. Then, when the toner density detection device detects that the toner density of the toner in the development device 22 has reached the predetermined level, the mohno pump 62 is stopped to end the toner supply. In this way, the toner density of the toner in the development device 22 can be kept constant by controlling the toner supply based on the result of detection performed by the toner density detection device.

Further, according to the image forming apparatus 1 of the present embodiment, a state of toner supply is detected based on the result of detection performed by the toner density detection device. For example, if the toner density of the toner in the development device 22 is below the predetermined level, and if the toner density does not increase even after a predetermined time period has passed since the mohno pump is driven to operate, it is detected that the toner in the toner cartridge 30 has run out (i.e., toner-end). In this way, the toner density detection device detects the toner supply state (i.e., toner-end). Thus, the toner-end sensor provided at an end of the conveying nozzles 63 on the side of the toner cartridge 30 is unnecessary. As a result, costs reduction can be expected.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus, comprising:

a plurality of image forming units detachably provided in the image forming apparatus and including at least two common image forming units having a common structure, each including a development device;

a toner supply device configured to supply toners of different colors to corresponding development devices of the plurality of image forming units;

a common-unit detection device configured to detect each one of the at least two common image forming units at installation thereof;

an initial operation execution device configured to execute an initial operation of supplying an amount of toner to a development device of each one of the at least two common image forming units detected by the common-unit detection device and mixing to charge the toner by friction for a preset time period before a formation of a reference image on an image carrier; and a determination device configured to detect a status as to whether the toner in the development device is charged to a threshold level upon completion of the initial operation, and to determine whether to mix the toner one more time for another time period based on the status detected.

2. The image forming apparatus as described in claim 1, further comprising:

a plurality of image carrying members; and a plurality of density detection devices each configured to detect a density of a reference toner image pattern formed on a corresponding one of the plurality of image carrying members, wherein the determination device detects a status as to, based on the density detected, whether the toner in the development device is charged to the threshold level upon completion of the initial operation.

3. The image forming apparatus as described in claim 2, wherein each one of the plurality of image forming units comprises a non-volatile memory configured to store information based on which the common-unit detection device detects the one of the at least two common image forming units at installation thereof.

4. The image forming apparatus as described in claim 3, wherein, when the determination device determines not to mix the toner one more time, the non-volatile memory stores information that an initial setting operation has completed.

5. The image forming apparatus as described in claim 4, wherein the non-volatile memory is configured to store information that the initial setting operation is proceeding while the initial operation is executed by the initial operation execution device.

6. The image forming apparatus as described in claim 4, wherein, when the common-unit detection device detects a non-common image forming unit at installation thereof, whether the non-common image forming unit is installed at an appropriate position in the image forming apparatus is detected.

7. The image forming apparatus as described in claim 6, wherein one of the plurality of image forming units is supplied with a black toner and is different in structure from the other plurality of the image forming units.

8. The image forming apparatus as described in claim 7, wherein each one of the plurality of image forming units comprises a toner density detection device configured to detect a toner density of toner contained in the development device thereof.

9. The image forming apparatus as described in claim 8, wherein toner supply is controlled based on the toner density detected by the toner density detection device.

10. The image forming apparatus as described in claim 9, wherein a toner supply state is detected based on the toner density detected by the toner density detection device.

11. An image forming apparatus comprising:

a plurality of image forming means for forming toner images of different colors, the plurality of image forming means including at least two common image forming means having a common structure;

toner supplying means for supplying toners of the different colors to corresponding development means of the plurality of image forming means;

common-unit detecting means for detecting each one of the at least two common image forming means at installation thereof;

initial operation executing means for executing an initial operation of supplying an amount of toner to developing means of each one of the at least two common image forming means detected by the common-unit detecting means and mixing to charge the toner by friction for a preset time period before a formation of a reference image on an image carrier; and determining means for detecting a status as to whether the toner in the development means is charged to a threshold level upon completion of the initial operation, and for determining whether to mix the toner one more time for another time period based on the status detected.

12. An image forming method comprising:

providing a plurality of image forming units including at least two common image forming units having a common structure, each including a development device;

confirming installment of each one of the at least two common image forming units in the image forming apparatus;

executing an initial operation of supplying an amount of toner from a toner supply device to a corresponding development device of each one of the at least two common image forming units confirmed as installed in the confirming step and mixing to charge the toner by friction for a preset time period before forming of a reference image on an image carrier;

detecting a status as to whether the toner in the development device is charged to a threshold level upon completion of the initial operation; and determining whether to mix the toner one more time for another time period based on the status detected.

13. The image forming method as described in claim 12, wherein the detecting step comprises: forming a reference toner image on an image carrying member corresponding to the development device; and detecting a density of the reference toner image used as a basis for detecting the status.

14. The image forming method as described in claim 13, wherein the confirming step comprises: referring to information stored in a non-volatile memory of each one of the plurality of image forming units as a basis for confirming the installation.

15. The image forming method as described in claim 14, further comprises: storing, in the non-volatile memory, information that an initial setting operation has completed, when it is determined unnecessary to mix the toner one more time.

16. The image forming method as described in claim 15, further comprises: confirming installing of a non-common image forming unit in the image forming apparatus; and detecting whether the non-common image forming unit is installed at an appropriate position in the image forming apparatus.

17. The image forming method as described in claim 16, wherein one of the plurality of image forming units is supplied with a black toner and is different in structure from the other plurality of the image forming units.

18. The image forming method as described in claim 17, further comprises: detecting a toner density of toner contained in the development device of the each one of the plurality of image forming units.

19. The image forming method as described in claim 18, further comprises: controlling toner supply based on the toner density detected in the toner density detecting step.

20. The image forming method as described in claim 19, further comprises: detecting a toner supply state based on the toner density detected in the toner density detecting step.

* * * * *